US005758442A

United States Patent [19]

Flanigan et al.

[11] Patent Number: 5,758,442

[45] Date of Patent: Jun. 2, 1998

[54] MODULAR WINDOW ELECTRONIC SIGN

[75] Inventors: William Flanigan, Rochester Hills; Mortimer Flanigan, Waterford, both of Mich.

[73] Assignee: Vultron, Inc., Rochester Hills, Mich.

[21] Appl. No.: 742,930

[22] Filed: Nov. 1, 1996

Related U.S. Application Data

[60] Provisional application No. 60/006,220 Nov. 3, 1995.

[51] Int. Cl. [6] ..... G09F 15/00

[52] U.S. Cl. ..... 40/624; 40/612; 40/574; 40/578; 40/492; 49/371

[58] Field of Search ..... 40/612, 624, 447, 40/448, 452, 457, 564, 574, 575, 578, 492; 49/371

[56] References Cited

U.S. PATENT DOCUMENTS

| | | | |
|---|---|---|---|
| 1,589,320 | 6/1926 | McConnell | 40/575 X |
| 1,853,927 | 4/1932 | Plym | 49/371 |
| 3,358,277 | 12/1967 | Selig | 40/452 X |
| 3,418,738 | 12/1968 | Goodman | 40/574 |

FOREIGN PATENT DOCUMENTS

| | | | |
|---|---|---|---|
| 2921392 | 11/1980 | Germany | 40/574 |

*Primary Examiner*—Daniel P. Stodola
*Assistant Examiner*—Tina R. Taylor
*Attorney, Agent, or Firm*—Brooks & Kushman P.C.

[57] ABSTRACT

A modular window electronic sign is provided for outdoor use. The sign is provided with a walk-in cabinet or housing with a forward facing informational display surface viewable through an opening in the cabinet. The window is comprised of a series of vertically elongated transparent lenses which have a truncated U-shaped cross section. The legs of the lenses extend rearwardly from the front face of the lens to behind the display surface. Water is prevented from entering into the enclosure through the window by seals on the legs of the lenses out of sight behind the display surface. A method of maintaining the sign from the interior of the cabinet is also provided by flexing and rotating the lenses, the front of the window may be cleaned from the interior of the cabinet. A method of maintaining and replacing modular electronic components of the sign from within the cabinet is also provided.

15 Claims, 5 Drawing Sheets

MODULAR WINDOW ELECTRONIC SIGN

This application claims priority from application Ser. No. 006,220 filed Nov. 3, 1996 entitled MODULAR WINDOW ELECTRONIC SIGN.

TECHNICAL FIELD

This invention relates to a large outdoor sign and methods for maintaining them.

BACKGROUND OF THE INVENTION

As the need for traffic control on the superhighway increases, there is an increased use of electronically controlled signs where information can be readily changed so to instruct motorists on a variety of subjects. To protect the signs and their electronic components, the signs must be effectively watertight and be able to withstand a wide variety of environmental conditions. Further, due to the high speeds on superhighways, signs have to be of sufficient size that they can be readily understood by motorists driving at high rates of speed. Further, the increased amount of information sought to be conveyed by the signs also have caused a general increase in the size of signs desired.

In the past, factors have limited the size and effectiveness of signs along superhighways. To protect the signs, there is need for a transparent window in front of the sign that will resist environmental impact upon the electronic sign components. As the size of the signs increase, it becomes increasingly difficult to find effective windows. Certain practical limitations limit the size of a sheet of transparent material, normally plastic, that protects the sign. These limitations include limitations on the size the sheets that can be economically manufactured and the size that can be transported. To avoid this problem, some in the past have grouped together smaller sized sheets of transparent material joined together by frames to form a broader window in front of the sign. However, the sign becomes partially obstructed by the framing members and problems related to maintenance increase. Further, the multiple frames increase the possibility that the environment may invade the interior of the sign and adversely affect the electronic display. Further, as the size of the sign increases, there is more chance of deflection of the material involved during adverse wind conditions.

Even where the above problems can be addressed, due to the nature of the signs, they must be periodically maintained. This requires periodic cleaning of the windows and replacement of parts that may become damaged. This is particularly a problem with signs that overhang busy freeways since the maintenance is preferably done without any obstruction of the traffic below the sign and without any danger of the maintenance crew.

To address these and other problems found in outdoor electronic large display signs, the invention provides a modular design which can provide an essentially unlimited facade with clear viewing of the operative portion of the sign. Further, the design provides for maintenance from the interior of the sign's walk-in cabinet to prevent disruption of traffic and increased safety for those maintaining the sign. Further, the design has an advantage of resisting environmental impacts and wind deflection.

DESCRIPTION OF THE PREFERRED EMBODIMENTS

Figure 1:
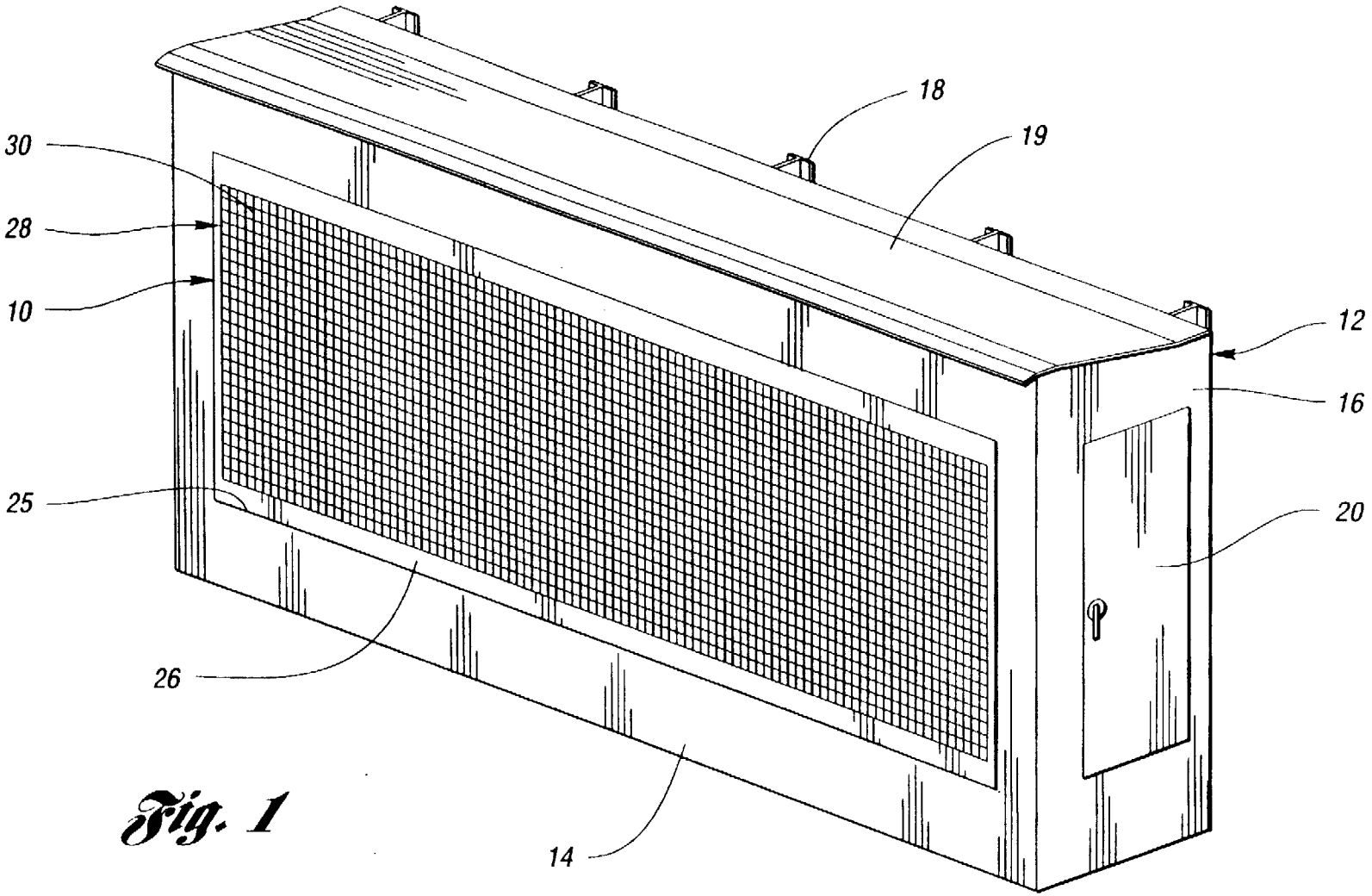
FIG. 1 is a perspective view of walk-in cabinet which includes a sign embodying the invention.
Figure 2:
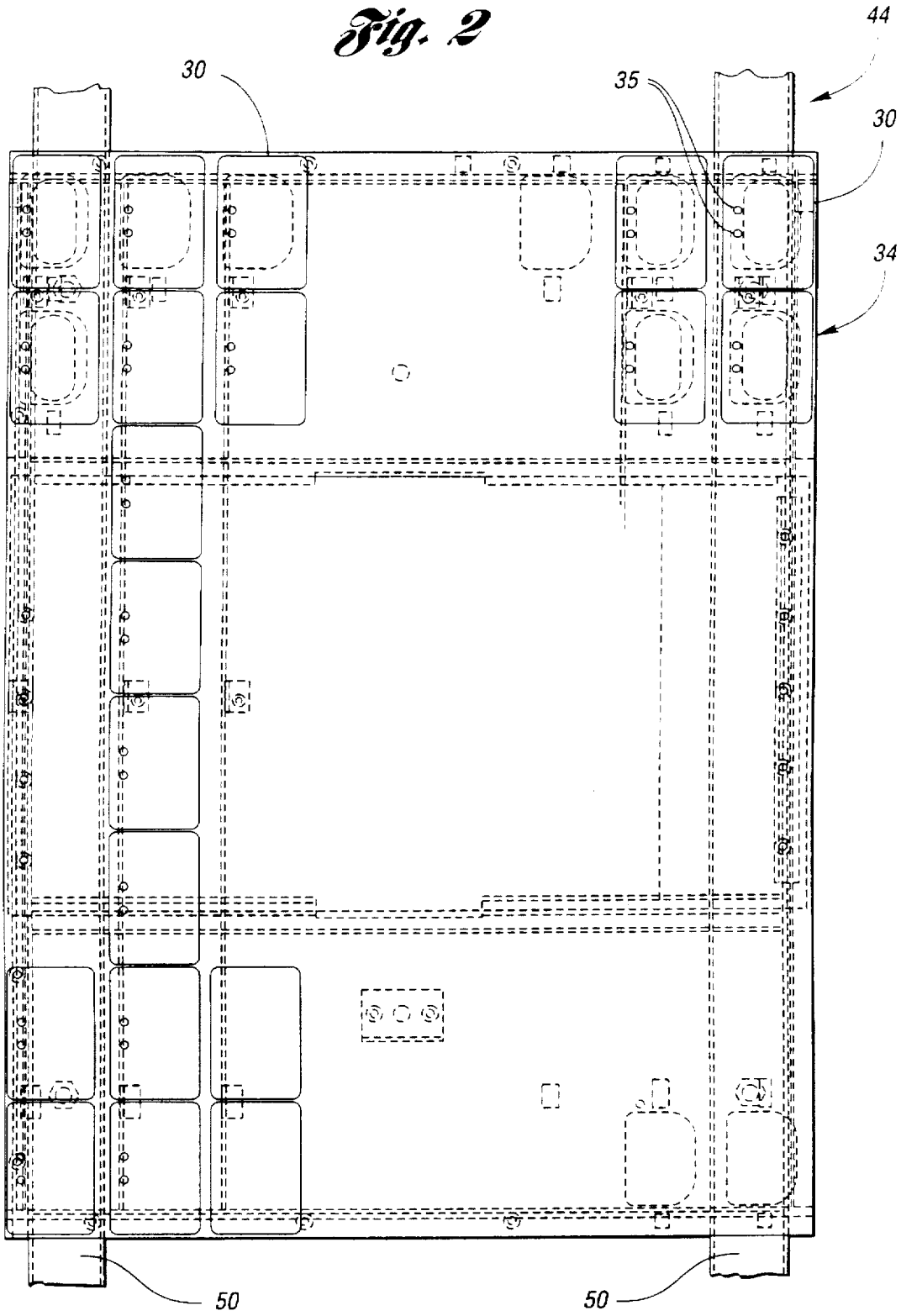
FIG. 2 is a representation of a middle display modules making up part of the sign of FIG. 1.
Figure 4:
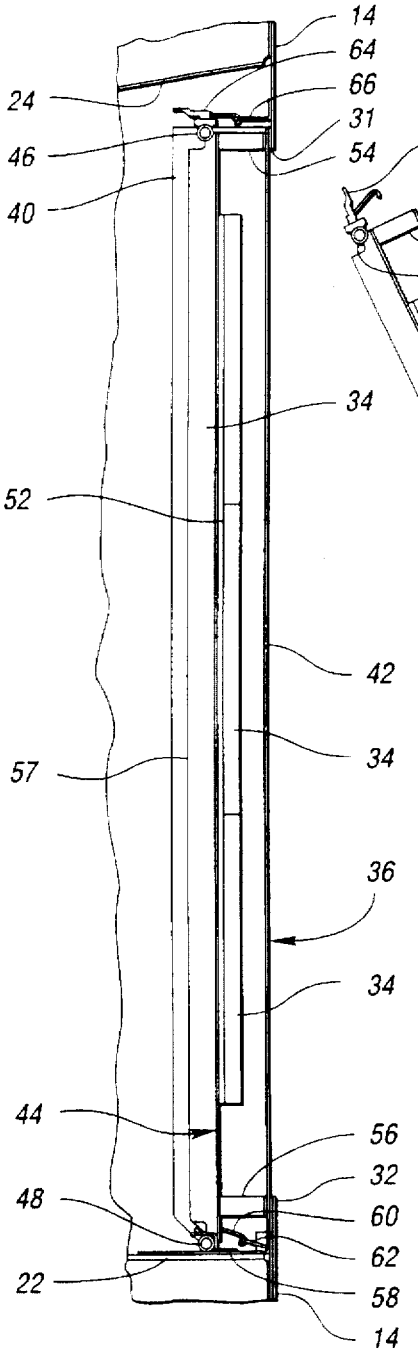
FIG. 4 is a side view of one module of a sign in its operative position with part of a second embodiment of a lens cut away.

As shown in FIG. 1, there is a sign 10 housed in a walk-in cabinet 12. The cabinet as shown in FIGS. 1 and 4 has a front wall 14, side walls 16 and a back wall (not shown) which is normally reinforced by means such as I-beams 18 and roof 19. There is a door 20 preferably in one of the sidewalls to allow easy access into the cabinet. Within the cabinet, there is provided a floor 22 and a ceiling 24. The ceiling and floor may include beams to give added strength to the cabinet.

In the front wall, there is provided a large opening 25 for a window 26 through which may be viewed an informational display surface 28. Surrounding the opening are top and bottom seals 31, 32 and side seals 33.

Figure 3:
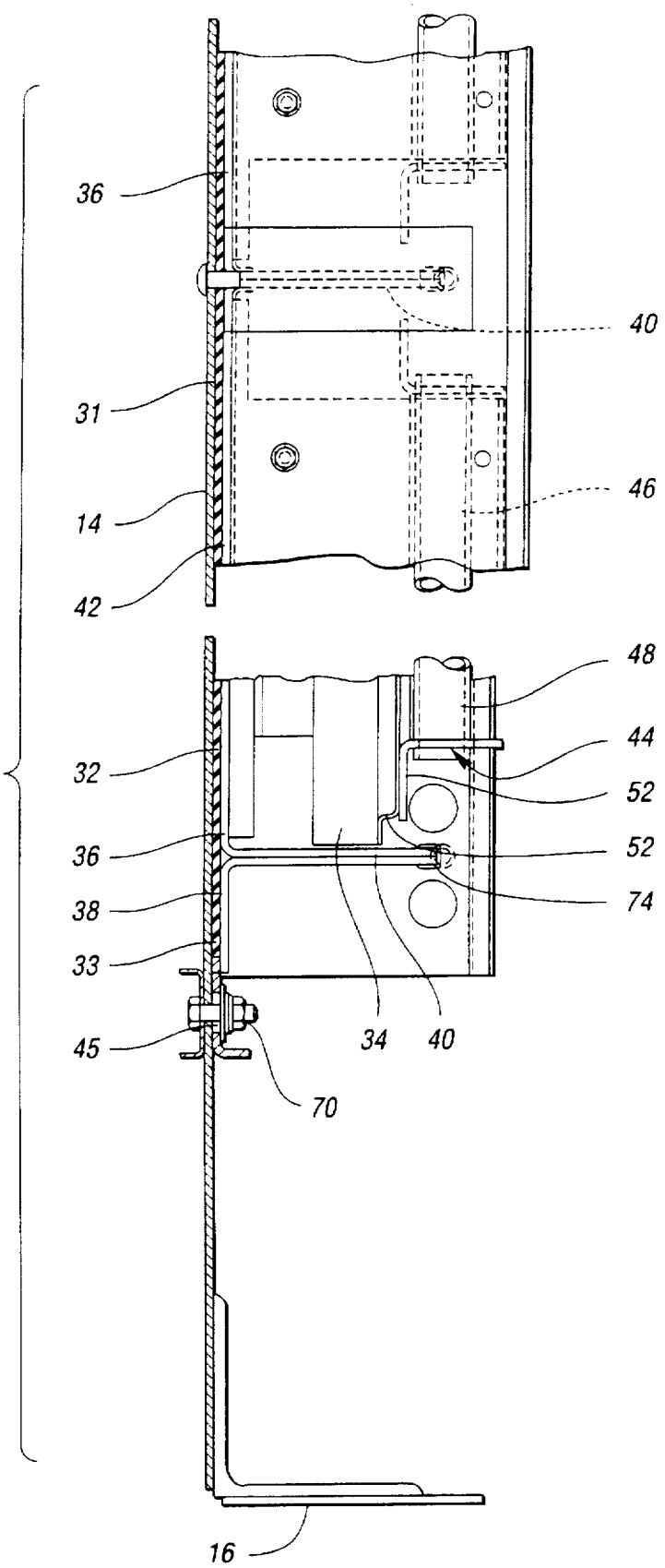
FIG. 3 is a partial cut away top view showing a modular construction of one embodiment of the sign.

An array of display units 30 cooperate to form the informational display surface 28 of the sign. Practical display devices employing arrays of light displaying diodes, flip units or the units capable of displaying dynamic and quiescent modes have been in use for many years. These devices when placed in arrays provide a dot matrix for displaying information when viewed from a distance. These units normally are arranged in standardized modules 34 as shown in FIG. 3. The modules in the current embodiment consist of display devices arranged in an 8×8 array. This is of such a size so that the modules can be assembled in a remote location in a lightweight standardized unit so to allow easy assembly or replacement should there be a failure of any part of the module. The display unit 30 is a flip assembly designed so it can be readily placed in suitable arrays. Suitable flip assemblies are commercially available from a variety of sources. The one used in this embodiment is of the type disclosed in U.S. Pat. No. 3,916,403, which is incorporated by reference. Display unit 30 consists of electromagnetic device having a display face including an indicator portion half of which is normally colored yellow or other suitable highly visible color and the other half is a dark color such as black. A flipper is positioned along the dividing line between the colored portion and the dark side and is aligned so that it can be flipped by an electromagnetic device between a position covering the colored portion or to a position covering the dark side. The flipper is similarly colored so that when the colored portion of the display face is covered, the flipper shows its dark side thereby rendering the entire indicator portion dark. When the flipper is related so it covers the dark side, it displays a colored portion thereby rendering the indicator portion colored.

It is intended that this invention is not to be limited to this type of display unit but can be used in conjunction with light circuits or other types of display or even a combination. Thus, there is shown openings 35 in the colored portion of the display unit suitable for the positioning of light emitting filaments which can be suitably covered or uncovered by the flipping member to allow the display unit to be operated at night.

Window 26 is comprised of a series of transparent lenses 36 together with a pair of transparent end closures 38 at each end of the window. Each lens is vertically elongated with a truncated U-shaped cross-section as best shown in FIG. 3. Each lens is preferably made of thin 0.125 inch thick clear polycarbonate. The legs 40 of the lens extend inwardly from a front or face portion 42 which is directed toward the viewer of the sign. The corners between the legs and face should be at as sharp an angle as reasonably possible. Each lens is designed so that three display modules 34 can be positioned one above another between the legs and maintained there on a suitable frame 44. A lens face of 12 to 20 inches wide and legs of three to six inches deep give a suitable cross section for lens of over six feet in height. In the preferred embodiment twelve lenses each having a face of approximately 16×80 inches are used side by side to yield an effective display surface 28 of over 15×5 feet.

Each end closure has a face portion but only one leg. The end closures include slots 45 to allow the closure to be bolted to the front wall. The slots allow for limited sideways movement of the closure prior to the bolts being tightened.

The module frame 44 consists of upper and lower tubes 46, 48 joined by vertically extending supports 50. Each module 34 is joined to the supports of the frame by suitable means including brackets 52. Also joined to the frame are upper and lower retainers 54, 56 which abut the lens to allow proper positioning of the frame and display units within the lens. The lens must be positioned sufficiently far from the display surface 28 to allow the display units to flip under all conditions during which the sign is intended to be used. The retainers also act to aid in holding the lens against the front wall of the cabinet. Position on the back of frame 44 is a dust cover 57 to aid in protecting the electronic components, i.e., the display units and associated electronics (not shown) joined to the frame.

Joined to the floor 22 of the cabinet is a tube positioning member 58 with a rearward facing opening into which lower tube 48 is placed during normal usage of the sign. The lower tube would normally rest upon the floor of the cabinet within the positioning member but may be rotated within the member. Joined to a lower portion of the frame, preferably on the lower tube, is a draw latch 60 which is normally hooked to lower bracket 62 joined to the front wall so to maintain the tube within the retaining member and draw it toward the front wall.

Positioned on the upper portion of the frame is a second upper draw latch 64 preferably positioned on the upper tube 46. This draw latch is normally hooked to upper bracket 66 which is joined to the front wall so to draw the upper tube toward the front wall.

This arrangement makes for an easily assembled and maintained sign. To assemble the sign, the cabinet is positioned along the highway with its opening facing the oncoming traffic. Since as explained below, all access to the sign may be done from within the cabinet, the cabinet can be positioned so to overhang the freeway and thus provide maximum viewing opportunity to the motorist. At one end of the opening is positioned an end closure 38. This end closure is then joined to the front wall by suitable means such as bolts 70 passing through slots 45.

The lenses 36 are positioned to abut first the end closure and then one another to provide the operative portion of the window. A second end closure is positioned at the other end of the window so that the lens are held in tight abutting relationship and then is bolted to the front wall of the cabinet.

In the first embodiment shown in FIG. 3, the legs of the lenses extend past the forward face of the display modules but need not extend past the frame. The ends of the legs are joined together by flexible trim 74 which also acts as a seal against water that might migrate to the back of the legs between abutting legs. An additional seal (not shown) extends in a downward angle from the rear of the leg to the front of the lens at a position corresponding essentially with the top of the lower edge of the opening. This will cause any precipitation found between the legs to migrate out of the cabinet along the seals.

In a second embodiment shown in FIGS. 4–7, a seal 76 is provided between the legs of the lenses that extends from the top of the opening at an angle towards the rear of the legs, downward behind the surface of the display modules and then at an angle back to the bottom of the opening. The seal should be positioned so not to block the view of the display. One such seal is joined to one leg of each lens with a corresponding seal on one of the end closures. The thickness of the seal is exaggerated in the figures and is intended to be as thin as possible so to allow the lenses and the end closures to essentially abut one another along their legs. Flexible trim is not necessary in this embodiment in that the lenses will be held in place during operation of the sign due to the friction caused by the seal between the legs.

The legs of the lens in the second embodiment extend backward beyond the rear of the frame as shown in FIG. 4. The second embodiment is installed in a manner similar to that described for the first embodiment. With both embodiments, during normal operation the frame is aligned parallel to the front face of the lens and held their by means of draw latches 60, 64 as shown in FIG. 4.

In this relationship the electronic portions of the sign are essentially sealed from rain. The sharp angle between the legs and face together with the close abutment and the seals around the opening will keep most rain from migrating into the seam between the lenses (and closures), which limits distortions in viewing the sign from the water. Any moisture that does enter the seams is prevented from reaching the electronic portions of the sign by the seals (and trim in the first embodiment) between the lenses (and closures).

The resultant window will resist deflections toward the sign surface 31 from wind or the impact of objects. Any inward flexing of a lens face will require the legs of that lens to move outwardly toward the adjacent lens (or closure), which will cause the inward flexing to be restrained. This prevents the operation of the sign from being adversely affected by stopping the deflection of the window prior to it interfering with the flipping of the display units.

The display is readily viewable from in front by the motorist. Further, even at an angle there is no noticable distortion in viewing the display unit despite being seen through three portions of the lenses, i.e., the legs of the adjacent lenses in addition to a front portion of a lens.

Figure 5:
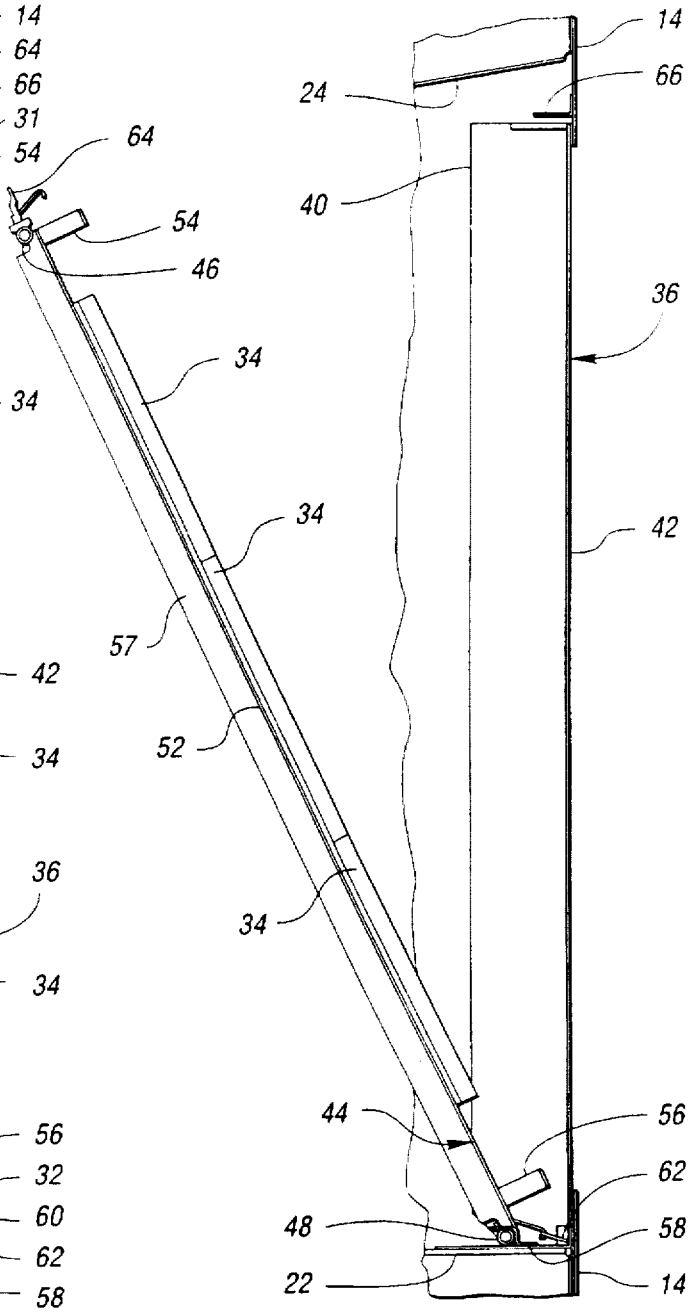
FIG. 5 is the same view as FIG. 4 only showing the electronic panel portion of the module being partially released and rotated for easy maintenance.

If there is a need to access the electronics connected with the sign, this can be done from the interior of the cabinet, usually by merely removing the dust cover. Should a module have to be replaced or the surface of the display be worked on this can be done from the interior of the cabinet also. In such a case the draw latches are released and unhooked. The frame can then be rotated rearwardly to allow easy access to the display module as shown in FIG. 5. If necessary, the entire frame can be removed by pulling the lower tube out of the tube retainer member. In this manner, an entire new frame installed easily from within the cabinet. While the frame is pivoted in this manner, the interior surfaces of the lens can also be cleaned.

Figure 7:
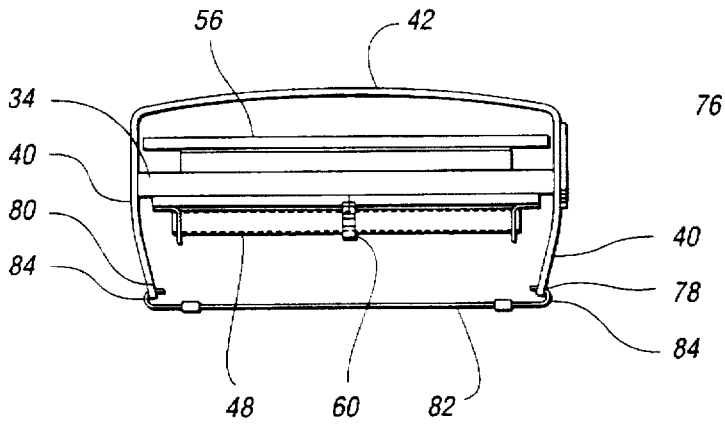
FIG. 7 is a top view of a module showing how the lens is bent to allow removal for maintenance.
Figure 6:
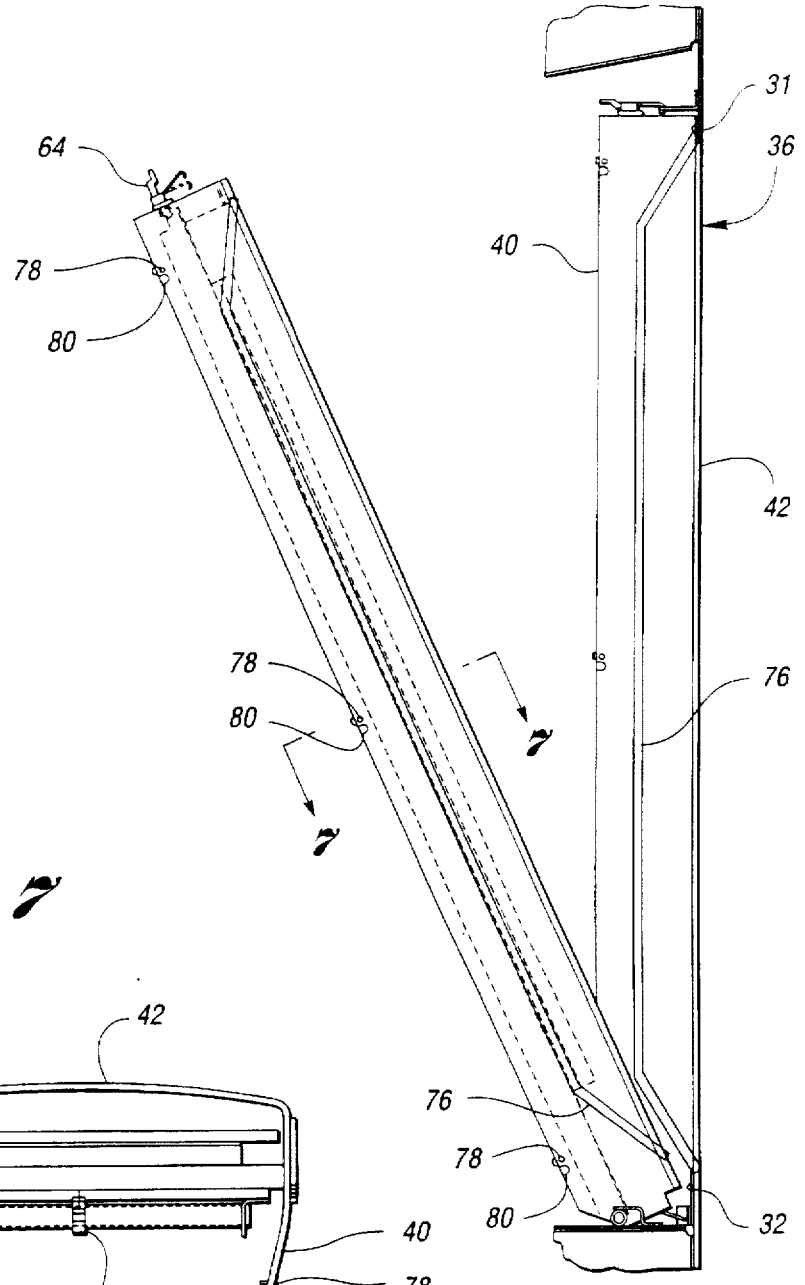
FIG. 6 shows an entire module having been released and tilted back for normal maintenance.

If it is desired to clean the outside surface of the face of the lens in the first embodiment, this would normally be accomplished in the traditional method of cleaning from the outside of the cabinet. However, the second embodiment provides a method of cleaning the exterior of the lenses so that it may be readily undertaken from the interior of the cabinet. Each lens is cleaned one at a time. The lens to be cleaned first is selected and the draw latches (top and bottom) of that lens and each of the adjacent lenses are opened. The latches should normally remain hooked at this point for safety. Each lens has on each leg a series of three spaced apart holes 78 and a corresponding slots 80. Along one leg, as shown in FIG. 6, the holes will be positioned above slots while on the other leg, not shown, the positions will be reversed. Three elastic cords 82 with hooks 84 at each end are then positioned between each pair of holes of each of the three legs. Nine cords are needed altogether. The alternating of the positions of the holes and slots on the adjacent legs provide clearance for placement of the hooks through the holes. This deforms the faces of each of the three lenses and allows the crown as shown in FIG. 7. This relieves the force on the side seals and the top and bottom seals.

The center lens now has its draw latches unhooked from their brackets and as shown in FIG. 6 may be tipped backwards exposing the outer face of the lens to the interior of the cabinet where it may be readily cleaned. This process is repeated for each of the lenses in turn to allow further cleaning. When dealing with a lens adjacent an end closure, the bolts holding the end closure are loosened to allow it to be moved away from the lens along slots 45.

While this sign is particularly suitable for use along highways, it is envisioned that other uses of the sign can be made where it is necessary to have a large sign exposed to the elements, such as in stadiums or other outdoor locales.

What is claimed is:

1. A modular window electronic sign for outdoor use comprising:

a housing;

a large forward facing information display surface;

a window filling an opening in the housing through which the display surface can be readily viewed from positions normal to display surface and at an angle other than normal thereto;

the window being comprised of a series of vertically elongated abutting lenses, including a first lens, last lens, and a plurality of transparent intermediate lenses;

each intermediate lens having a face portion forwardly situated from and substantially parallel to the display surface, and a pair of side legs extending rearwardly from the face portion, the legs extending a sufficient distance so that a portion of each leg is rearward of the display surface;

the first and last lenses each having a face portion substantially aligned with the face portions of the intermediate lenses and at least one leg extending rearwardly from the face portion, the leg extending a sufficient distance so that a portion of the leg is rearward of the display surface;

each intermediate lens leg normally abutting the leg of the adjacent lens; and a seal against water migration located behind the display surface joined to one of each pair of abutting lenses between each pair of abutting legs on that portion of the leg rearward of the display surface so as to not interfere with viewing of the display surface.

2. The sign of claim 1, wherein the sign has an operative position where all lenses are in an upright position and a maintenance position where one of the intermediate lens is angled rearwardly into a rear service area from where the front of the face of the lens may be cleaned.

3. The sign of claim 2 where each intermediate lens cooperates with a latch on an upper portion of the housing to releasably hold the lens in the upright position.

4. The sign of claim 2, wherein the intermediate lenses normally resist moving from the upright position due to friction between the legs due to the seal, but where the intermediate lens include an attachment area for a flexing device that acts to move the legs of the lens toward one another to release the friction.

5. The sign of claim 4, where the flexing device is elastic cord.

6. The sign of claim 1 where the intermediate lenses have a truncated U-shaped cross section and the first and last lenses have only one leg.

7. The sign of claim 1, wherein the display surface and the opening each have a bottom and the bottom of display surface ends above the bottom of the opening; and the seal angles forwardly from behind the display surface at approximate the bottom of the display surface to a position on the leg substantially corresponding to the bottom of the opening.

8. A modular window electronic sign for outdoor use comprising:

a housing;

a large forward facing information display surface comprising an array of modules of electronic components which project information as part of the display surface;

a window filling an opening in the housing through which the display surface can be readily viewed from a position normal to display surface and at an angle thereto;

the window being comprised of a series of vertically elongated abutting lenses, including a first lens, last lens, and a plurality of transparent intermediate lenses;

each intermediate lens having a face portion forwardly situated from and substantially parallel to the display surface, and a pair of side legs extending rearwardly from the face portion, the legs extending a sufficient distance so that a portion of each leg is rearward of the display surface;

the first and last lenses each having a face portion substantially aligned with the face portions of the intermediate lenses and at least one leg extending rearwardly from the face portion, the leg extending a sufficient distance so that a portion of the leg is rearward of the display surface;

each intermediate lens leg normally abutting the leg of the adjacent lens; and at least one of the modules positioned between each of the legs of the intermediate lenses.

9. The sign of claim 8, further comprising a frame between the legs of each intermediate lens on which any module between the legs of that lens are replaceably placed;

top and bottom latches for releasably holding the frame substantially parallel to the face of the lens; and the frame rotatable within a positioner joined to the housing when the top latch is released and removable from the positioner with both the top and bottom latches are released.

10. The sign of claim 9, where the frame includes a member for abutting the face of the lens for positioning the frame relative to the lens.

11. The sign of claim 9, wherein the sign has an operative position where all lenses and frames are in an upright position and a first maintenance position where one of the intermediate lens frames is angled rearwardly into a rear service area and a second maintenance position where one of the intermediate lens and its corresponding frame are angled rearwardly into the service area from where the front of the face of the lens then be cleaned.

12. A method for maintaining an outdoor sign, having a large forward facing information display surface, a window filling an opening in the housing through which the display surface can be readily viewed, the window being comprised of a series of vertically elongated abutting lenses, comprising a first lens, a last lens, and a plurality of transparent intermediate lenses, each intermediate lens having a face portion forwardly situated from and substantially parallel to the display surface, and a pair of side legs extending rearwardly from the face portion, the first and last lenses each having a face portion substantially aligned with the face portions of the intermediate lenses, and having at least one leg extending rearwardly from the face portion, each intermediate lens leg normally abutting the leg of one of the adjacent lenses, and a seal joined to one of each pair of abutting lenses, which creates friction that acts to resist movement of the lenses relative one another, the method consisting of the steps of selecting one of the intermediate lenses to undergo maintenance;

relieving the friction holding selected lens relative to the adjacent lenses by flexing the legs of the selected lens towards one another;

angling the selected lens rearwardly so to allow access to the front of the face of the lens.

13. The method of claim 12 further comprising the step of flexing the legs of each of the lenses adjacent to the selected lens toward one another to further relieve the friction prior to the step of angling the selected lens rearward.

14. A method for maintaining an outdoor sign, having a large board facing the information display surface, a window showing an opening in the housing to which the display surface can be readily viewed, the window being comprised of a series of vertically elongated abutting lenses, having a first lens, a last lens, and a plurality of transparent intermediate lenses, each intermediate lens having a face portion forwardly situated from and substantially parallel to the display surface, and a pair of side legs extending rearwardly from the face portion, the first and last lenses each having a face portion substantially aligned with the face portions of the intermediate lenses, and having at least one leg extending rearwardly from the face portion, each intermediate lens leg normally abutting the leg of one of the adjacent lenses, a separate rotatable module with a top and bottom including a portion of the display surface located between the legs of each intermediate lens normally held in place parallel to the lens face by a top and bottom elastic latch, and a service area located within the housing behind the display surface, the method consisting of the steps of selecting one of the modules to undergo maintenance;

the releasing the top latch;

rotating the top of the selected module away from the face to allow access to the entire module from the rear;

undertaking maintenance activities from the service area;

rotating the module into its normal position; and latching the latch.

15. The method of claim 14 where the necessary maintenance requires replacement of the module and each separate module is removably joined to the housing within a bracket, the method further comprising the additional steps of releasing the bottom latch after the top of the module is rotated;

removing the module from the bracket into the service area;

placing a replacement module into the bracket;

latching the bottom latch;

rotating the replacement module into a position parallel to the face of the lens; and latching the top latch.

* * * * *